United States Patent [19]

Ames et al.

[11] Patent Number: 4,688,999

[45] Date of Patent: Aug. 25, 1987

[54] WELL PUMP

[75] Inventors: Kenneth R. Ames, Pasco, Wash.; James M. Doesburg, Chicago, Ill.

[73] Assignee: Battelle Devepment Corporation, Columbus, Ohio

[21] Appl. No.: 849,248

[22] Filed: Apr. 8, 1986

Related U.S. Application Data

[63] Continuation-in-part of Ser. No. 656,116, Sep. 24, 1984, abandoned.

[51] Int. Cl.[4] ..... F04B 21/04; F04B 39/10

[52] U.S. Cl. ..... 417/550; 417/DIG. 1

[58] Field of Search ..... 417/550, 552, 553, DIG. 1; 92/243, 245, 248

[56] References Cited

U.S. PATENT DOCUMENTS

| | | | |
|---|---|---|---|
| 213,173 | 3/1879 | Coates | 417/328 |
| 797,111 | 8/1905 | Hellman | 92/78 |
| 2,258,009 | 10/1941 | Horton | 417/313 |
| 2,377,916 | 6/1945 | Anderson | 417/553 |
| 2,915,986 | 12/1959 | Sisson | 417/550 |
| 2,973,833 | 3/1961 | Cook | 92/78 |
| 2,984,190 | 5/1961 | Dibley | 417/550 |
| 3,095,825 | 7/1963 | Sandberg | 417/571 |
| 3,176,595 | 4/1965 | Schwartz | 92/245 |
| 3,270,687 | 9/1966 | Hoffinga | 417/547 |
| 3,904,326 | 9/1975 | Clement | 417/571 |
| 4,023,467 | 5/1977 | Thurner | 417/552 |
| 4,240,507 | 12/1980 | Hokkanen | 417/328 |
| 4,301,971 | 11/1981 | Cornelius | 417/550 |

FOREIGN PATENT DOCUMENTS

| | | | |
|---|---|---|---|
| 47802 | 2/1978 | Japan | 417/550 |
| 938580 | 10/1963 | United Kingdom | 417/550 |

*Primary Examiner*—William L. Freeh

*Attorney, Agent, or Firm*—Joseph J. Hauth; Robert Keith Sharp

[57] ABSTRACT

A well pump includes a piston and an inlet and/or outlet valve assembly of special structure. Each is formed of a body of organic polymer, preferably PTFE. Each includes a cavity in its upper portion and at least one passage leading from the cavity to the bottom of the block. A screen covers each cavity and a valve disk covers each screen. Flexible sealing flanges extend upwardly and downwardly from the periphery of the piston block. The outlet valve block has a sliding block and sealing fit with the piston rod.

11 Claims, 5 Drawing Figures

WELL PUMP

INTRODUCTION

This is a continuation-in-part of application Ser. No. 656,116, filed Sept. 24, 1984, now abandoned.

This invention relates to a well pump which is cheap to manufacture and long-lasting. It is so constructed that it avoids the necessity of the usual packing materials for the piston and inlet and/or outlet valves, and is capable of mass production at low cost.

BACKGROUND

There has been in the past few years considerable interest in the development of hand-operated water pumps for use in developing countries. Such pumps are, of course, also of value in remote areas of the United States and other industrialized countries where electric power is not readily available. It is also desirable that such pumps be capable of operation by power when it is available. Such pumps should be economical to manufacture on a large scale and be of such design that extensive upkeep is not necessary. Numerous pumps of this general character are described in a series of reports entitled "World Bank Technical Papers - Rural Water Supply and Pumps Project". The pump identified as the "Nepta Pump" is described in report #2 of that series, pages 32–36. This pump includes a flexible cord for pulling the piston up and a tension spring for pulling it down. The piston and valve structures illustrated are quite complicated and in the summary the pump was described as "expensive to buy".

SUMMARY OF THE INVENTION

Our invention is directed to a pump of the general type described above, but in which the piston and inlet and/or outlet valve assembly are made of plastic and the piston is so constructed that it does not require packing but is self-sealing with the pump cylinder.

DETAILED DESCRIPTION

Figure 1:
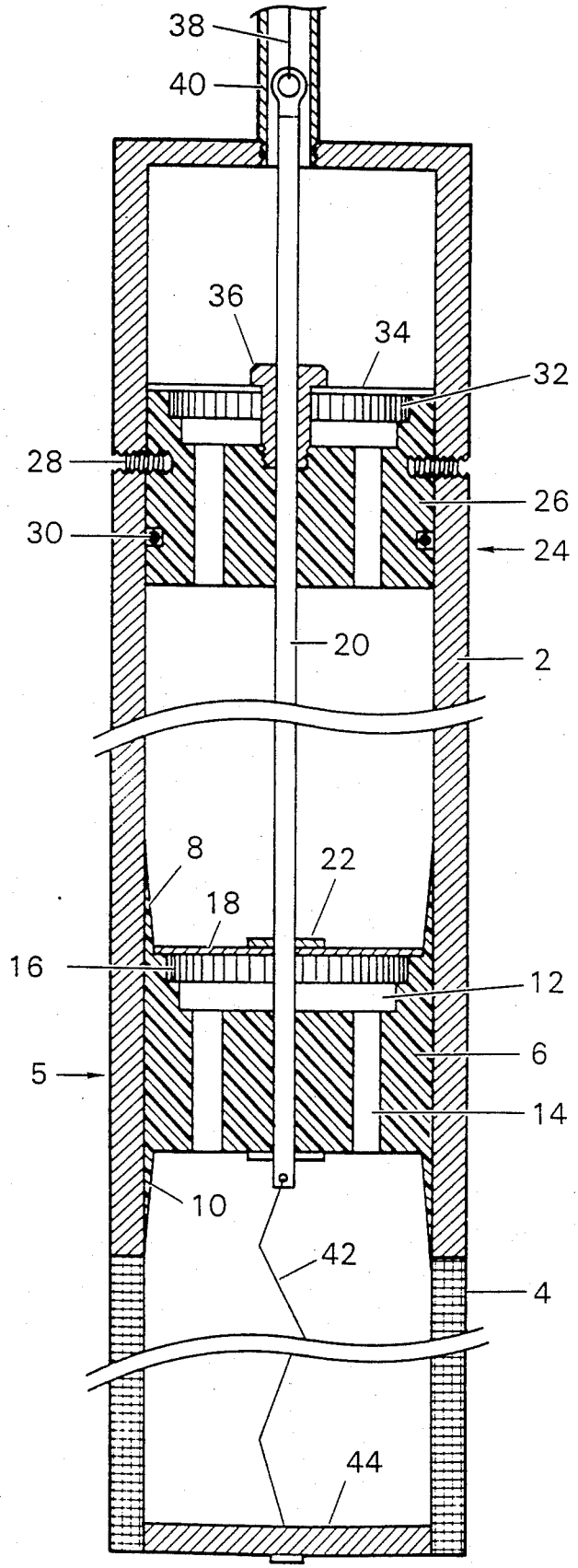
FIG. 1 is a vertical section of one embodiment of our pump.

Referring to FIG. 1 the pump includes a cylinder 2, the upper portion of which is imperforate and preferably made of stainless steel. The lower portion of the cylinder wall 4 is in the form of a screen. This screen is preferably made up of a plurality of circumferential, trapezoidal bars which have their widest portions on the outside. On the interior of these bars are vertical bars, also of trapezoidal shape. The circumferential bars are closely spaced to form a slotted screen. The vertical bars serve as supports. This is a screen which has a very low resistance to water flow. It is commercially available both in metallic form and made of plastic.

Within the cylinder 2 is a piston 5, including a piston body 6 which is preferably made of injection-molded polytetrafluoroethylene (PTFE). The material is sold under the trademark "Teflon". It is long-lasting and has excellent anti-friction characteristics. The piston includes flanges 8, 10 which extend upwardly and downwardly from the body 6. The piston body includes a cavity 12 and a number of flow channels 14. Seated in the upper portion of the piston body above cavity 12 is a screen 16. This screen is made up of horizontal bars, trapezoidal in shape with their wider portions uppermost. They are closely spaced to provide a screen which, however, has little resistance to water flow. These bars are supported from beneath by relatively widely spaced bars at right angles to them and joined to them. On top of the screen is a valve disk 18, also made of PTFE. In the embodiment shown, it is flexible and clamped to piston rod 20 by lockwasher 22. However, it may be rigid and slidable on rod 20, a stop being provided on rod 20 to limit its travel.

As shown by the drawing, the piston body 6 has a height which is approximately the same as its diameter. It is, therefore, substantially rigid in the axial direction. Because of their thinness, flanges 8 and 10 are flexible in the radial direction.

In the upper portion of cylinder 2 is an outlet valve assembly indicated generally as 24. It includes a valve block 26 which is of the same general construction as piston body 6. However, the flange 8 and 10 are not required. Valve block 26 is held in cylinder 2 by screws 28 which are backed out into threaded holes in the cylinder 2. It is sealed in the cylinder by O-ring 30. At the top of valve block 26 are screen 32 and valve disk 34 which are of the same structure as screen 16 and valve disk 18, respectively. Valve disk 34, in the embodiment shown, is held in place by hollow bolt 36 which is threaded into valve block 26. The upper end of stainless steel piston rod 20 is connected to a flexible cord 38 which extends upwardly through discharge pipe 40. The upper end of cord 38 is connected to any suitable hand or powered mechanism which will periodically apply tension to it. In this modification, the lower end of piston rod 20 is connected to a tension spring 42 which in turn is connected to a rigid member 44 at the bottom of cylinder 2.

Figure 2:
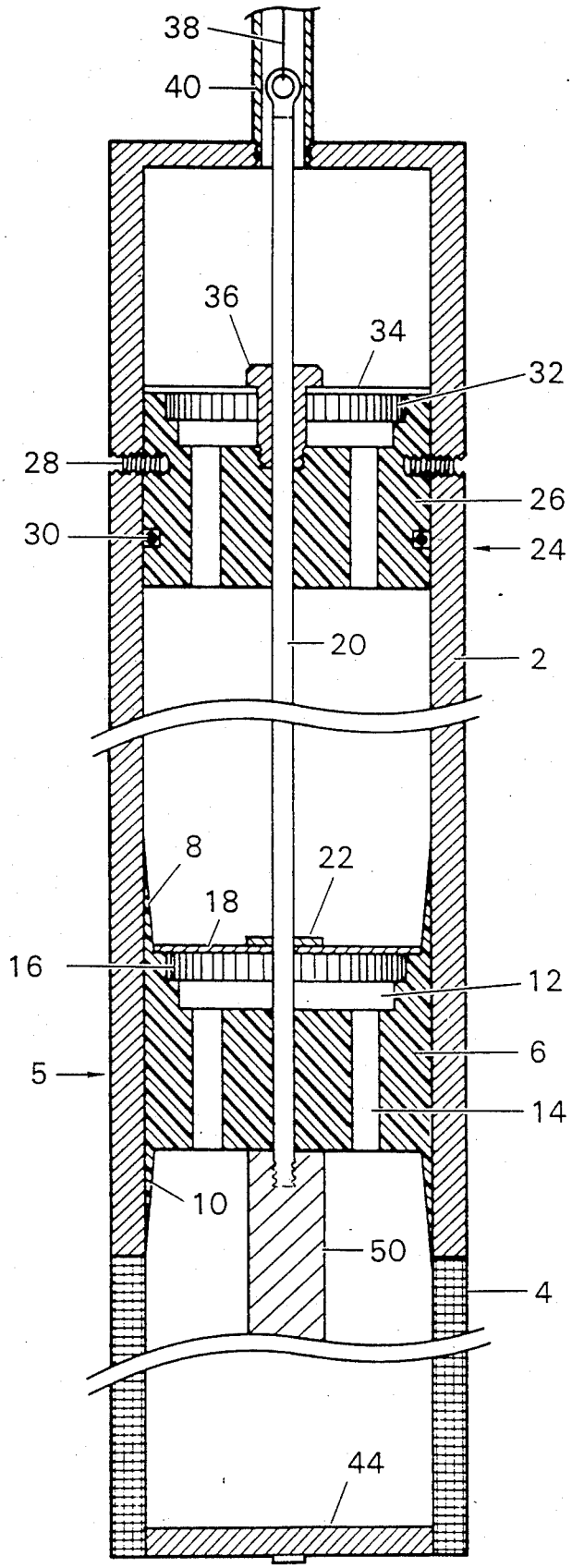
FIG. 2 is a vertical section of a second embodiment of our pump.

In FIG. 2 the structure is identical to that of FIG. 1, except that the spring 42 is replaced by a weight 50.

This is a bucket valve force pump and it is preferably mounted below the level of the ground water. Assuming the piston 6 is in its highest position, tension is released on cord 38. This piston is either drawn down by spring 42 (FIG. 1) or caused to descend by weight 50, FIG. 2. Flange 10, which is flexible, is forced against the wall of screen 4 or cylinder 2 and forms a seal. Water is forced through channels 14, cavity 12, and screen 16 raising valve disk 18 and allowing water to accumulate above the piston. Tension is then applied to cord 38. Piston 6 is drawn upwardly, forcing flanges 8 against the cylinder wall and forming a seal. This forces water upwardly through the valve assembly 24 raising valve disk 34 and forcing the water upwardly through pipe 40. When tension is again released, the pressure forces valve disk 34 against the top of screen 32 forming a seal and preventing backflow.

A valve assembly of the same general structure as assembly 24 may be used below piston 5 instead of, or in addition to, assembly 34.

The PTFE of which valve block 26 is made has excellent anti-friction properties in contact with metal. The piston rod 20 is made originally with an interference fit and quickly works itself into a low-friction sealing relationship. The flanges 8 and 10 of the piston are flexible and act as sealing means so that the piston does not require packing. The PTFE, while relatively expensive as a material, can be readily formed by injection molding so that the parts can be mass produced at a low expense. The absence of packing which needs periodic renewing makes for long life. This design, therefore, provides a low-cost, highly effective pump.

Figure 3:
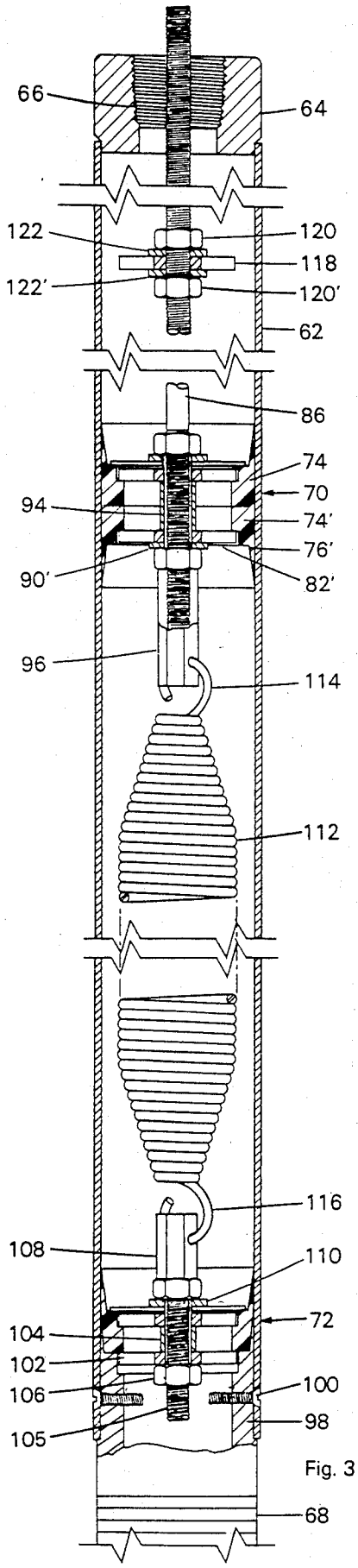
FIG. 3 is a vertical section of another embodiment of the pump.
Figure 5:
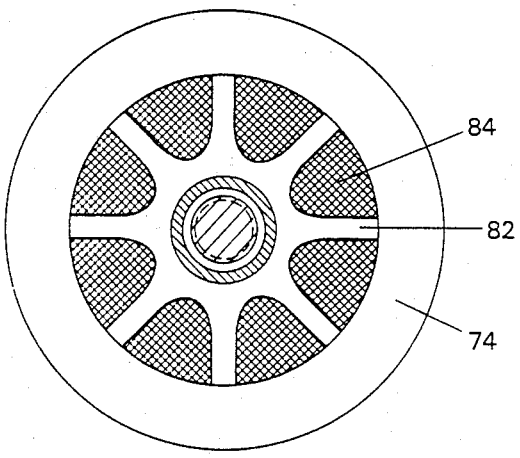
FIGS. 4 and 5 are detailed views of the valve forming part of the piston and inlet valve assembly of the pump shown in FIG. 3.
Figure 4:
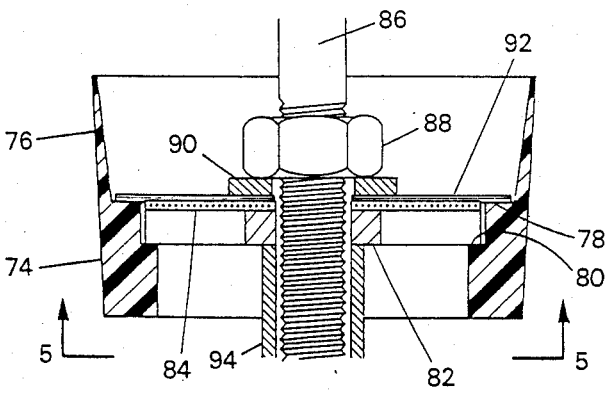

Still another embodiment, which is the form we prefer at present, is shown in FIGS. 3, 4 and 5.

This embodiment includes an elongated casing 62 having, at its upper end, a plug 64, provided with pipe threads 66. At the bottom of the casing is an inlet screen 68. While the screen may be of any desired form, it is preferably made of encircling bars which taper from the outside inwardly, and are welded to vertical supporting bars. This is a well known type of screen which has very low resistance to water flow. Within the casing are a piston assembly 70, and an inlet valve assembly 72, which is fixedly but removably mounted in the casing.

The piston assembly and the valve assembly each include one or more valve cups which are best shown in FIGS. 4 and 5. This valve cup 74 is made of a plastic material, preferably PTFE. This valve cup includes a flange 76, which by reason of its thinness, is flexible. The body of cup 74 is sufficiently thick to be substantially rigid, at least in a vertical direction. The cup includes two ledges 78 and 80. A perforated or spoked plate 82 rests on ledge 80, and supports a screen 84 which has small, closely spaced openings. For convenience, the description will not be made with reference to the piston assembly 70.

A piston rod 86 is mounted axially of casing 62 and extends through the piston assembly 70. In addition to the cup 74, the piston assembly includes a second cup 74' which is identical to cup 74. The flange 76 of cup 74 extends upwardly, while that of cup 74' extends downwardly. A plate 82' identical to plate 82 (FIGS. 4 and 5) is mounted against one of the shoulders of cup 74'. The piston rod 86 includes a threaded portion extending completely through the piston assembly. A nut 88 and a washer 90 clamp a flexible valve disk 92 against screen 84. Between plates 82 and 82' is a spacer 94. Below plate 82' are a washer 90' and an elongated nut 96. Nuts 88 and 96 clamp the plates 82 and 82' together against the spacer 94. This arrangement clamps the bodies 74 and 74', the screen 84, and the flexible disk 92 together into a unitary structure which is substantially rigid in a vertical direction but which has, as mentioned above, flexible flanges 76 and 76' which act as seals with the casing 62.

The valve assembly 72 includes a cup and associated screen, valve disk and perforated plate, which are identical to those in the piston and shown in FIG. 4. Below the valve assembly is a metallic sleeve 98, which is fixed in the casing by screws 100 and which is joined to screen 68 by pipe threads (not shown). A perforated or spoked plate 102 is welded or otherwise permanently fixed to sleeve 98. A spacer 104 extends between the plate 102 and the plate corresponding to plate 82 forming part of the valve. A threaded rod 105 extends completely through the lower valve assembly and the plate 102. Below plate 102 is a nut 106. An elongated nut 108, and a washer 110 are positioned above the valve disk. Nuts 106 and 108 clamp the valve assembly to the fixed plate 102.

Mounted between the piston and the valve assembly is a spring 112. This spring has gooks 114 and 116 at its upper and lower ends respectively. These hooks engage holes in elongated nuts 96 and 108 respectively.

Above the piston is a stop which includes a perforated or spoked plate 118 which can be identical with the plate 82 of the piston assembly. The important characteristics are that it has a diameter, less than the interior diameter of casing 62, but larger than the bore in end plug 64, and that it is so constructed as to offer minimum resistance to flow of water. It is held in place on rod 86 and by nuts 120 and 120' and washers 122 and 122'.

The operation of the embodiment of the pump is as follows:

The pump is immersed in the ground water, at least as far as the inlet valve assembly 72, and preferably the entire pump is immersed.

As in the other modifications, the pump rod 86 is connected to a flexible cord. Starting with the pump in the position shown in FIG. 3, the rod 86 and piston assembly 70 are drawn upwardly. This draws water in through valve assembly 72 and, if there is water above piston assembly 70, forces it upwardly through plug 64 and the pipe to which it is connected. When tension on the cord is released, the spring 112 draws the piston down, closing the valve in valve assembly 72 while opening that in the piston, thus leaving the casing filled with water. These steps are continuously repeated.

The stop 118 prevents accidentally damaging the piston by pulling it against plug 64 (or pulling the piston out of the casing) on breakage of spring 112, and also serves to prevent over-extending that spring, thus reducing the likelihood of such breakage.

While PTFE is particularly desirable for use in the piston and valve assembly, other moldable polymers having good stability and low coefficients of friction in contact with metals may be substituted. Examples are polyethylene, nylon, and Viton (copolymer of vinylidene fluoride and hexafluoro propylene).

Instead of stainless steel, the metallic members may be made of corrosion-resistant metals, e.g., nickel, or simple alloys, such as bronze.

While we have described certain embodiments of our invention in detail, it will be apparent that various other changes can be made. We therefore wish our patent coverage to be limited solely by the scope of the appended claims.

We claim as our invention:

1. A pump comprising a pump cylinder, a piston within said cylinder, an entrance for fluid below said piston, an outlet above said piston, and means for raising and lowering said piston, said piston comprising a cylindrical body or organic polymer having a diameter such as to fit closely in said cylinder, said piston including a first check valve so constructed and arranged as to permit flow of fluid only upwardly through and relative to said body;

said body comprising radially flexible flanges extending upwardly and downwardly from its periphery and extending completely about said periphery in close-fitting engagement with said cylinder;

said first check valve comprising a substantially planar screen having numerous closely spaced small openings on the top of said body and a thin, flexible disc of organic polymeric material fixed on the upper surface of said planar screen and substantially covering the area bounded by said upwardly extending flange;

said body being provided with a cavity immediately below and covered by said planar screen member and at least one passage extending from said cavity to the bottom of said body.

2. A pump as defined in claim 1 wherein the body of said piston is made of molded PTFE.

3. A pump as defined in claim 1 wherein said piston comprises two identical cups of organic polymer and means clamping said cups together with the flange of one cup extending upwardly and the flange of the other cup extending downwardly.

4. A pump as defined in claim 1 and further comprising a check valve assembly in said cylinder so constructed and arranged as to permit flow of fluid upwardly through said cylinder but prevent return flow;

said check valve assembly comprising a cylindrical body of organic polymer having a diameter such as to fit closely in said cylinder, said body being fixedly but removeably mounted in said cylinder and having at least one passageway, extending through said block axially of said cylinder and a second check valve so constructed and arranged as to permit fluid flow only upwardly through said passageway;

said second said check valve comprising a planar screen having numerous closely spaced small openings above said passageway and a thin, flexible disc of organic polymer having its central portion fixed on the upper surface of said horizontal screen member and substantially covering the upper surface of said body;

said body being provided with a cavity immediately below and covered by said planar screen and communicating with said axially extending passageway.

5. A pump as defined in claim 4 wherein said piston comprises two identical cups of organic polymer and means clamping said cups together with the flange of one cup extending upwardly and the flange of the other cup extending downwardly and wherein said check valve assembly comprises a cup identical to one of the cups forming part of said piston.

6. A pump as defined in claim 4 wherein said valve assembly is positioned above said piston and further comprising a piston rod connected to said piston and extending through said check valve assembly and having a sliding fit with the body of said check valve assembly.

7. A pump as defined in claim 6 wherein the bodies of said piston and said check valve assembly are made of molded PTFE.

8. A pump as defined in claim 1 and comprising a flexible cord connected to said piston rod for raising said piston and means below said piston for lowering said piston when tension is released on said flexible cord.

9. A pump as defined in claim 8 wherein said means for lowering said piston is a weight.

10. A pump as defined in claim 8 wherein said means for lowering said piston is a spring.

11. A pump as defined in claim 10 wherein said valve assembly is fixed in said casing below said piston and said spring connects said piston and said valve assembly.

* * * * *

UNITED STATES PATENT AND TRADEMARK OFFICE

CERTIFICATE OF CORRECTION

PATENT NO. : 4,688,999

DATED : August 25, 1987

INVENTOR(S) : Kenneth R. Ames, James M. Doesburg

It is certified that error appears in the above—identified patent and that said Letters Patent is hereby corrected as shown below:

Column 4, line 54, change "or" to - - of - - -.

Signed and Sealed this

Twenty-ninth Day of December, 1987

*Attest:*

DONALD J. QUIGG

*Attesting Officer*

*Commissioner of Patents and Trademarks*